US006416147B1

(12) United States Patent
Li et al.

(10) Patent No.: US 6,416,147 B1
(45) Date of Patent: Jul. 9, 2002

(54) PRINTING DEVICE WITH OPTIMIZED PRINT HEAD POSITIONING LOGIC

(75) Inventors: Yung-Yi Li, Yung-Kang; Ben-Chuan Du, Hsin-Tien, both of (TW)

(73) Assignee: Acer Communications and Multimedia Inc., Taoyuan (TW)

( * ) Notice: Subject to any disclaimer, the term of this patent is extended or adjusted under 35 U.S.C. 154(b) by 36 days.

(21) Appl. No.: 09/740,893

(22) Filed: Dec. 21, 2000

(51) Int. Cl.[7] ..... B41J 29/38
(52) U.S. Cl. ..... 347/9
(58) Field of Search ..... 347/9, 37, 41–43; 400/323, 323.1, 63, 706; 358/1.5

(56) References Cited

U.S. PATENT DOCUMENTS

| | | | | | |
|---|---|---|---|---|---|
| 4,933,875 | A | * | 6/1990 | Kojima | 358/1.5 |
| 6,082,849 | A | * | 7/2000 | Chang et al. | 347/14 |
| 6,157,461 | A | * | 12/2000 | Doron et al. | 347/12 |
| 6,179,407 | B1 | * | 1/2001 | Bockman | 347/19 |
| 6,302,505 | B1 | * | 10/2001 | Askeland et al. | 347/10 |
| 6,305,781 | B1 | * | 10/2001 | Hull | 347/12 |

OTHER PUBLICATIONS

IBM Technical Disclosure Bulletin, Rule for the Selection of Double–Dotting Location, Jul. 1986, US vol. 29, pp. 764–767.*

IBM Technical Disclosure Bulletin, Midline Stopping at Character Boundaries With a Multi–Line All–Points–Addressable Print Head, Sep. 1986, US vol. 29, pp. 1502–1505.*

* cited by examiner

*Primary Examiner*—John Barlow
*Assistant Examiner*—K. Feggins
(74) *Attorney, Agent, or Firm*—Winston Hsu

(57) ABSTRACT

A printer has a print path disposed along a left-and-right direction, a driving system for moving a print head left or right along the print path, a control circuit for controlling the driving system, and a look-ahead system. The print head is used to perform a printing operation that forms at least one pixel on a media in a print swath. The look-ahead system determines a plurality of different paths that cover at least three print swaths, and computes a print time required by the driving system to cover each path. The look-ahead system then selects a path having the shortest print time, and the control system directs the driving system to follow this path.

20 Claims, 9 Drawing Sheets

PRINTING DEVICE WITH OPTIMIZED PRINT HEAD POSITIONING LOGIC

BACKGROUND OF THE INVENTION

1. Field of the Invention

The present invention relates to a printing device. More specifically, the present invention discloses a printing device with an improved method for positioning the print head so as to speed up the overall printing process.

2. Description of the Prior Art

One of the most common of printing methods today for printers is the use of a print head that moves left and right along a print track. Please refer to FIG. 1. FIG. 1 is a partial perspective view of a print head 10 slidably disposed along a print track 12 of a printer 5. The print head 10 slides left and right on the print track 12, along the direction of arrow RL. Rollers 14 both secure paper 7 under the print head 10, and increment the paper 7 in successive steps past the print track 12. With each pass of the print head 10, the print head 10 leaves a swath of pixels on the paper 7, and the paper 7 is incremented forward by a predetermined amount that is equal to the printing height of the print head 10. Each pass of the print head 10 is termed a "print swath", and the print head 10 traces a succession of print swaths across the paper 7 to finish a printing operation. The print swaths stack atop each other to fully cover all of the printed portions of the paper 7. Note that a print swath is not necessarily equal to a printed line of text. Depending upon the relative heights of the line of text and the printing height of the print head 10, several print swaths may be required to cover a line of text, or the print swath may cover more than just a single line of text in one print swath.

The print swaths of early printers rigorously covered every portion of the paper 7, scanning left-to-right, much as we read text. The resulting print swaths are indicated in FIG. 2. FIG. 2 is a diagram of print swaths of an early printer. The arrows indicate the direction and length of travel of the print head 10 as the print head 10 forms pixels on the paper 7. The shaded portion 16 indicates the actual extents of the printed region of the paper 7. Clearly, a great deal of time is wasted moving the print head 10 from the right side of the paper 7 to the left side to begin a print swath. Additional time is wasted by causing the print head 10 to traverse beyond the end points of the printed region 16.

A substantial savings in printing time was achieved by having the print swaths parse the paper 7 in an alternating fashion from left-to-right and right-to-left. This is indicated in FIG. 3. FIG. 3 is a diagram of print swaths of a second prior art printer. With the print swaths of FIG. 3, the print head 10 no longer behaves like the carriage return of an old-fashioned typewriter, but instead prints when traveling both to the left and to the right. This significantly decreased the amount of time required to complete a printing operation. However, the print head 10 still continues to cover the entire left and right extents of the paper 7, thus overshooting the actual printed region 16, which results in wasted time.

With the most recent advance in print head 10 positioning logic, the print head 10 no longer moves beyond the extents of the actual printing region, which is shown in FIG. 4. FIG. 4 is a diagram of print swaths of a third prior art printer. It appears that this must be the quickest method to perform a printing operation, as it minimizes wasted movement of the print head 10.

The above would seem to be the end of the story. However, under slightly more scrutiny, it becomes clear that even the above method is somewhat wasteful of time. Please refer to FIG. 5. FIG. 5 is a diagram showing print regions 20 and 22 covered by a printer using the print method of FIG. 4. The two print regions, 20 and 22, are shown covered by print swaths 21 and 23, respectively. Print swath 23 is on a line below that of print swath 21. The print head 10 scans from the left of print region 20 to the right of print region 20, then continues moving to the rightmost edge of print region 22. The paper 7 is advanced, and then the print head 10 scans from the right of print region 22 to the left of print region 22. As the print head 10 uses a fixed, alternating cycle of left-to-right and right-to-left movement, the print head 10 must traverse through region 24, performing no useful printing function, to position itself on the right side of print region 22. Time would clearly be saved if the print head 10 printed both swaths 20 and 22 in the same left-to-right manner, with the paper 7 advancing when the print head 10 was between the two print regions 20 and 22. In this case, the print head 10 would then have to traverse through the smaller distance of region 25.

SUMMARY OF THE INVENTION

It is therefore a primary objective of this invention to provide a printer with an improved print head positioning method to speed up a printing process.

The present invention, briefly summarized, discloses a printer having a print path disposed along a left-and-right direction, a driving system for moving a print head left or right along the print path, a control circuit for controlling the driving system, and a look-ahead system. The print head is used to perform a printing operation that forms at least one pixel on a media in a print swath. The look-ahead system determines a plurality of different paths that cover at least three print swaths, and computes a print time required by the driving system to cover each path. The look-ahead system then selects a path having the shortest print time, and the control system directs the driving system to follow this path.

It is an advantage of the present invention that by having a look-ahead system that computes a plurality of paths to cover at least the next three print swaths, the print head will always follow the optimal path to finish a printing operation. This results in a significant reduction in the time required to complete the printing operation.

This and other objectives of the present invention will no doubt become obvious to those of ordinary skill in the art after reading the following detailed description of the preferred embodiment, which is illustrated in the various figures and drawings.

DETAILED DESCRIPTION OF THE PREFERRED EMBODIMENT

Figure 6:
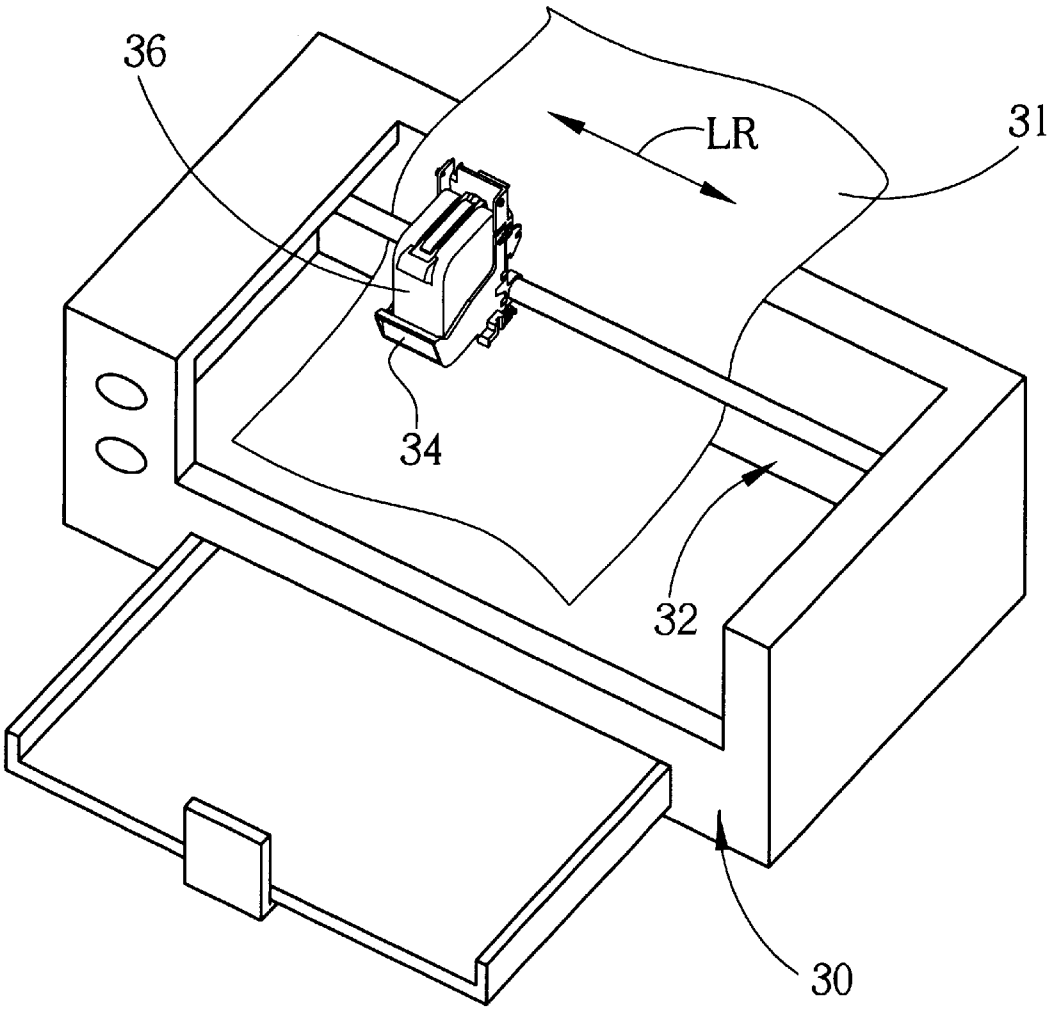
FIG. 6 is a perspective view of a printer according to the present invention.
Figure 7:
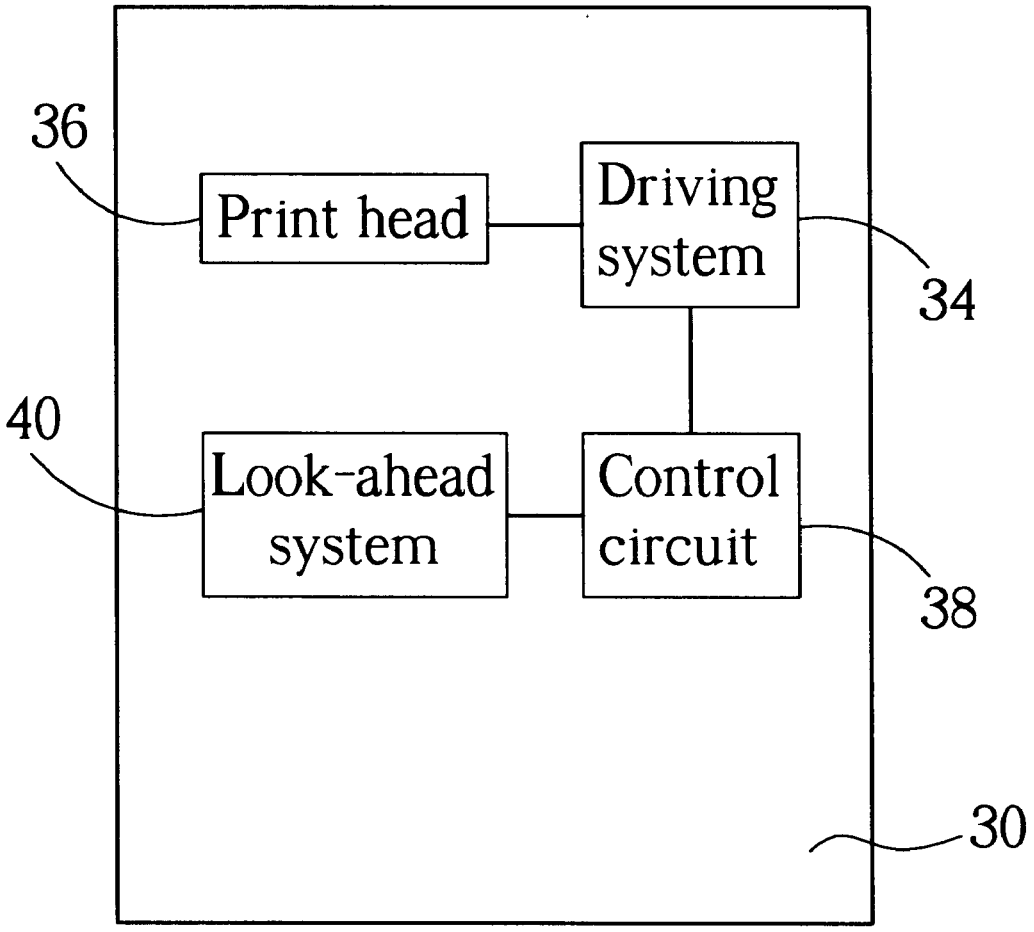
FIG. 7 is a function block diagram of the printer of FIG. 6.

Please refer to FIG. 6 and FIG. 7. FIG. 6 is a perspective view of a printing device 30 of the present invention. FIG. 7 is a function block diagram of the printing device 30. The printer 30 has a print path 32 which runs along a left-and-right direction, as indicated by arrow LR. A driving system 34 moves a print head 36 left and right along the print path 32. The print head 36 may be of any type, such as the dot-matrix print head of a line printer, an ink jet print head, or the like. The print head 36 is used to form pixels on a media 31, and moves left and right, describing a plurality of print swaths as it covers the regions on the media 31 which need to be printed during a printing operation. The driving system 34 is controlled by a control circuit 38. The control circuit 38 uses a look-ahead system 40 to control the driving system 34 so that the print head 36 follows a path that covers the print swaths in a minimum amount of time.

The look-ahead system 40 implements the method of the present invention, described at length below, to find a path that most quickly covers at least the next three subsequent print swaths of the print head 36. The look-ahead system 40 analyzes the printing extents of the print swaths and finds a plurality of different paths that cover these print swaths. The look-ahead system 40 then determines, for each path, the time the driving system 34 will need to have the print head 36 follow the path. Of all these paths and associated times, the look-ahead system 40 picks the path with the shortest time. The control circuit 38 then uses this path to direct the operations of the driving system 34. The print head 36 thus follows the quickest path possible to complete the printing operation.

Figure 1:
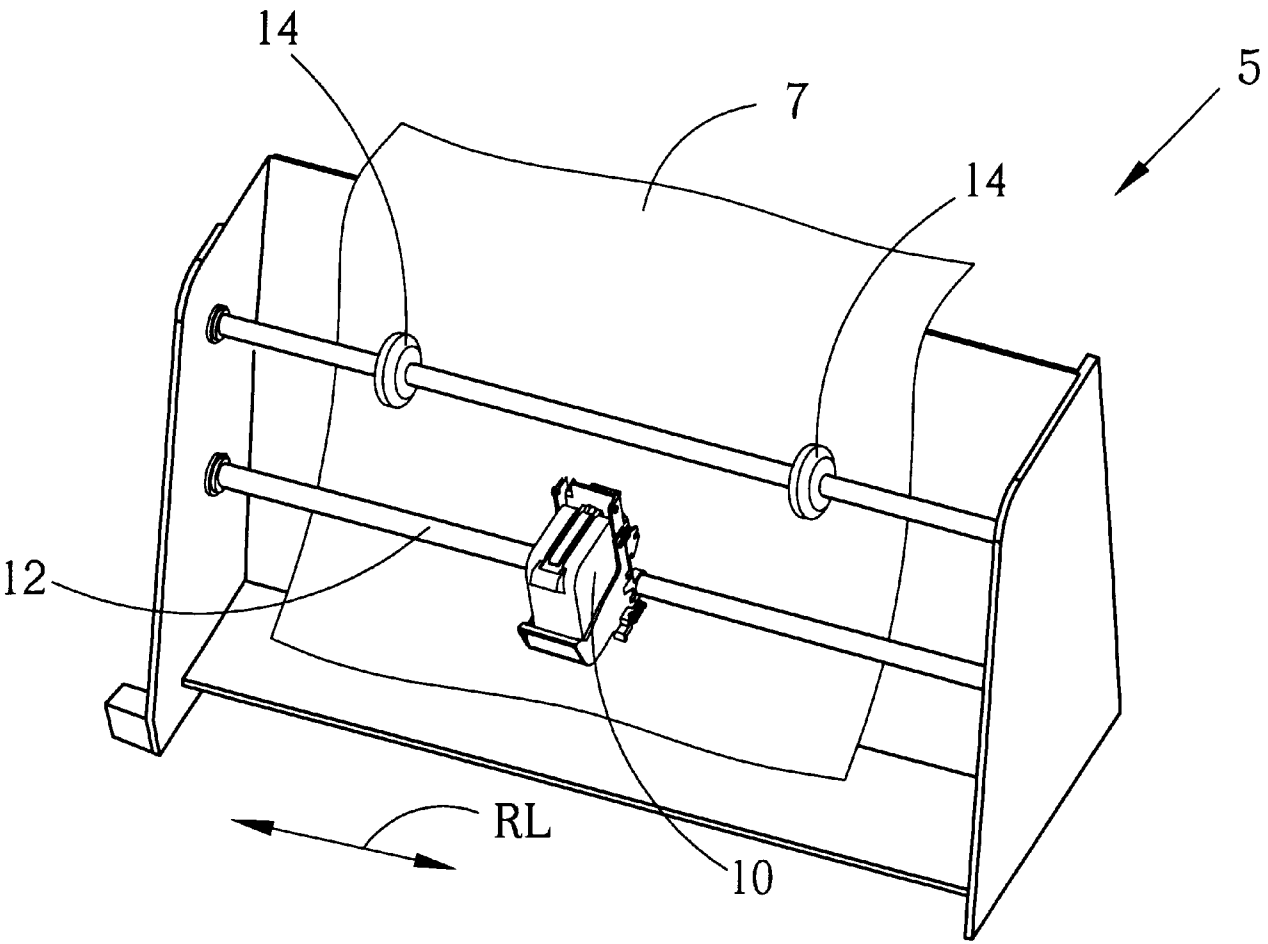
Fig. 1 Prior art
FIG. 1 is a partial perspective view of a print head slidably disposed along a print track of a prior art printer.
Figure 2:
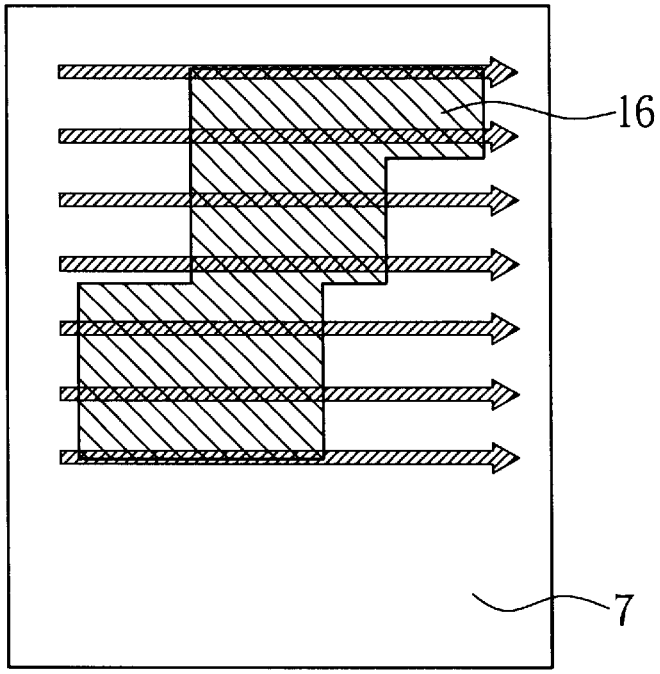
Fig. 2 Prior art
FIG. 2 is a diagram illustrating the print swaths of a first prior art printer.
Figure 3:
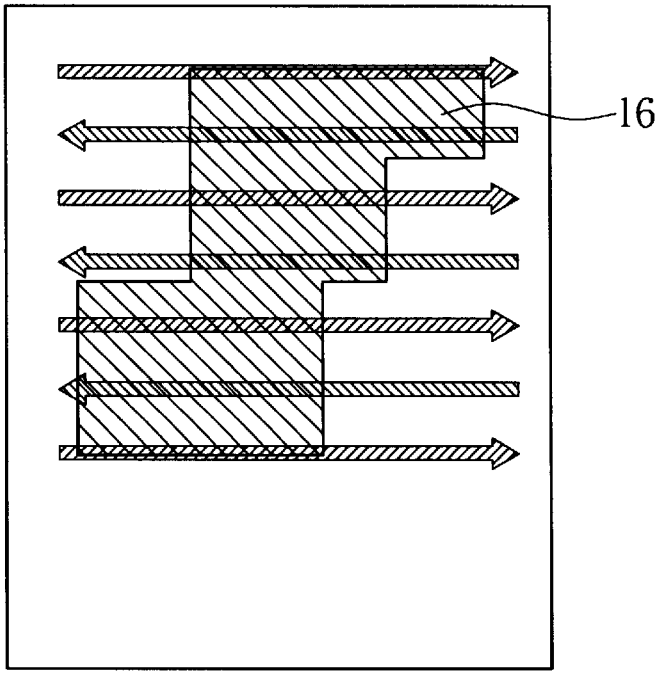
Fig. 3 Prior art
FIG. 3 is a diagram illustrating the print swaths of a second prior art printer.
Figure 4:
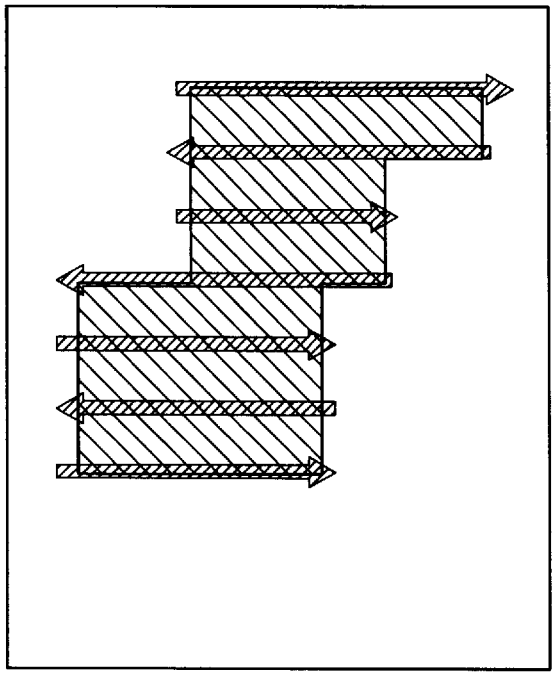
Fig. 4 Prior art
FIG. 4 is a diagram illustrating the print swaths of a third prior art printer.
Figure 5:
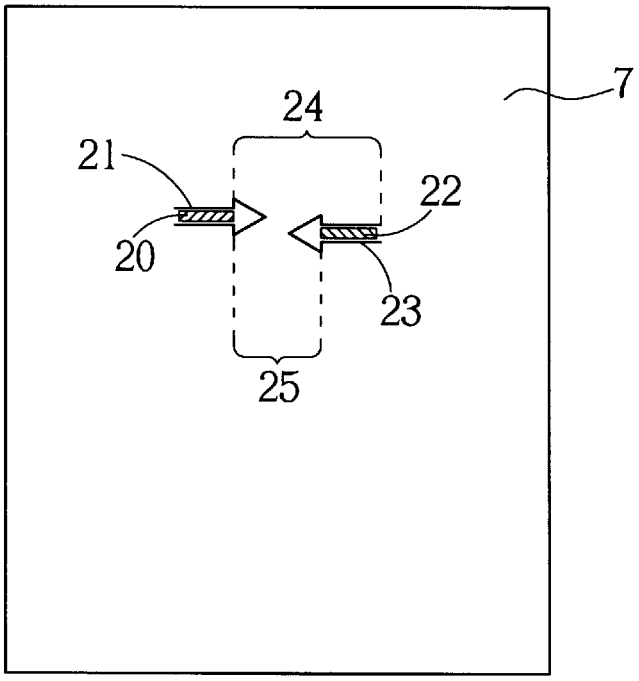
Fig. 5 Prior art
FIG. 5 is a diagram showing a print region covered by print swaths of a prior art printer using the print method illustrated in FIG. 4.
Figure 8:
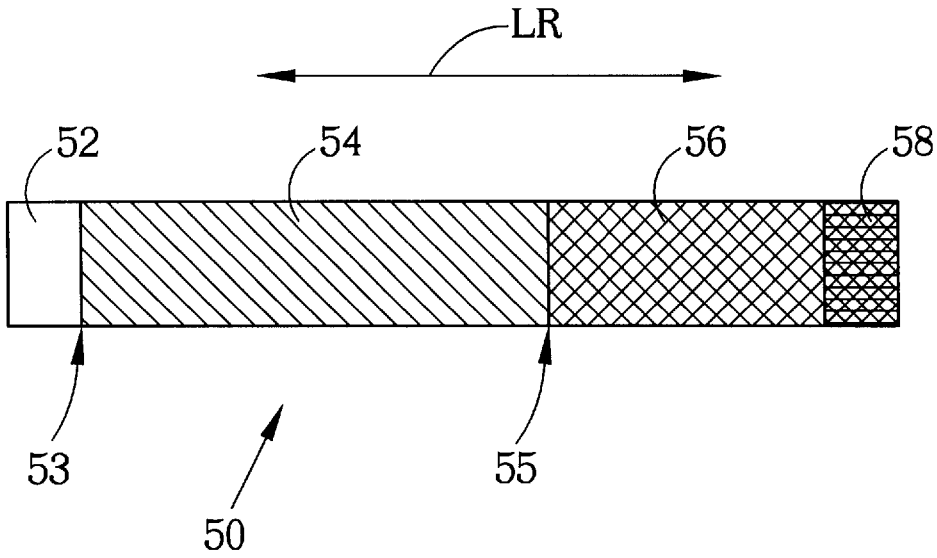
FIG. 8 is a diagram illustrating a print swath of the present invention.

To introduce the method of the present invention, which is utilized by the look-ahead system 40, please refer to FIG. 8 with reference to FIGS. 1 and 2. FIG. 8 is a diagram illustrating a print swath 50 of the present invention. Although a specific example, the print swath 50 is used to illustrate the forms of print swaths in general. The print swath 50 lies along the left-and-right (LR) direction, as indicated by the arrow LR. The print swath 50 has an acceleration region 52, a printing region 54, an excess travel region 56 and a deceleration region 58. The acceleration region 52 is used by the driving system 34 to accelerate the print head 36 up to a fixed, predetermined printing speed. The printing speed is essentially constant over both the printing region 54 and excess travel region 56. The printing region 54 delineates the area in which the print head 36 forms pixels on the media 31. Typically, the printing region 54 marks the farthest left and right extremes of pixels formed by the print head 36 in the print swath 50. No printing is performed in the excess travel region 56. The purpose of the excess travel region 56 is simply to bring the print head 36 into position for the printing region of a subsequent print swath. The deceleration region 58 is used by the driving system 34 to bring the print head 36 to rest. This occurs when, for the next print swath, the print head 36 needs to change its direction of motion, or the media 31 needs to be advanced. The following should be noted about a general-case print swath:

1. Print swath 50 indicates left-to-right motion of the print head 36. When the direction of motion of the print head 36 is from right-to-left, i.e., opposite to that of print swath 50, the positions of the acceleration region 52 and the deceleration region 58 are swapped.
2. The general case print swath does not need to have an excess travel region 56.
3. The print region 54 can be before the excess travel region 56, in relation to the direction of motion of the print head 36.

Print swaths are "chained together" by their acceleration and deceleration regions. Thus, the acceleration region of a current print swath is connected to the deceleration region of a prior print swath. This connection maybe either immediate, or through an intermediate region of excess travel, which is discussed later. Each print region of a print swath can be thought of as having a start point and an end point. The print head 36 begins the printing operation for a print swath at, or just after, the start point of the print swath. Similarly, the print head 36 finishes printing at, or just before, the end point of the print swath. For example, the print region 54 of print swath 50 has a start point 53, after which the print head 36 begins to form pixels. The print swath 50 also has an end point 55, before which the print head 36 stops forming pixels. Excess travel times are incurred by the print head 36 as it travels from the end point of a prior print swath to the start point of a current print swath. It is a fundamental function of the look-ahead system 40 to compute such excess travel times.

The look-ahead system 40 considers four unique conditions when calculating the excess travel time between a current print swath and a next print swath. These four conditions are briefly introduced as follows:

1) The print head 36 reverses direction once to get from the end point of the prior print swath to the start point of the current print swath.
2) The print head 36 reverses direction twice to get from the end point of the prior print swath to the start point of the current print swath.
3) The print head 36 does not reverse direction to get from the end point of the prior print swath to the start point of the current print swath, and there is no overlapping of the deceleration and acceleration regions of the prior and current print swaths, respectively.
4) The print head 36 does not reverse direction to get from the end point of the prior print swath to the start point of the current print swath, and there is overlapping of the deceleration and acceleration regions of the prior and current print swaths, respectively.

Figure 9:
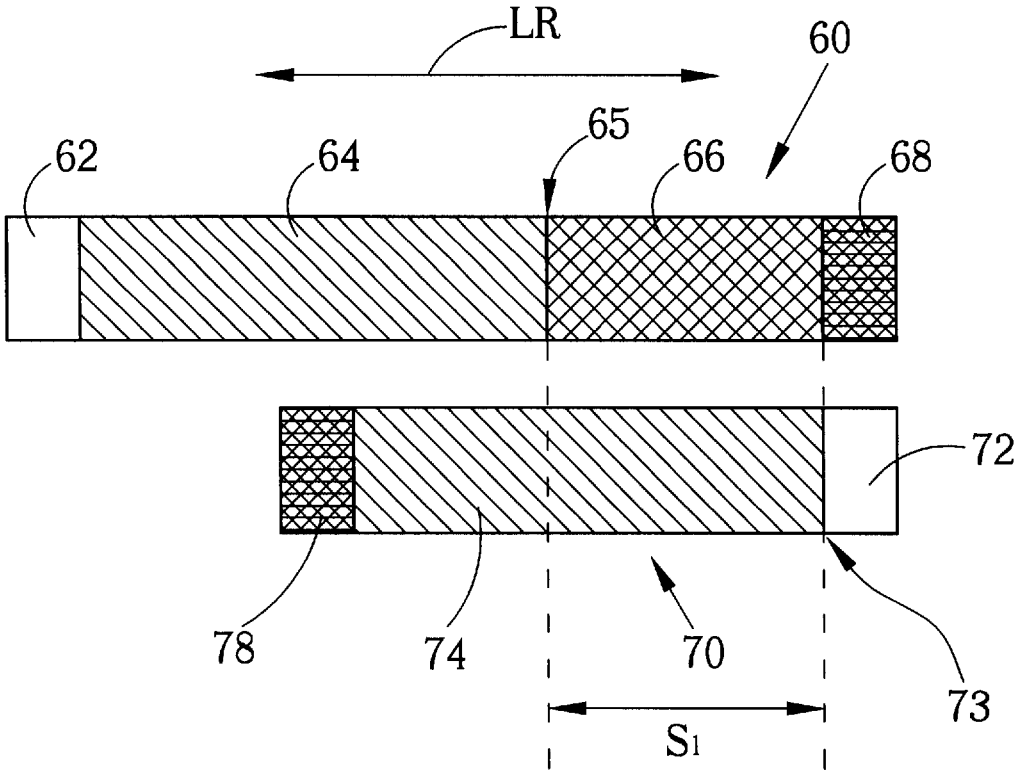
FIG. 9 illustrates an excess travel time satisfying a first condition of the present invention.

Please refer to FIG. 9, with reference to FIGS. 6 and 7. FIG. 9 illustrates an excess travel time satisfying the first condition of the present invention. FIG. 9 shows a prior print swath 60 and a current print swath 70. The current print swath 70 is covered by the print head 36 immediately after the prior print swath 60. Although the print swaths 60 and 70 are shown vertically separated from each other, as, indeed, they are on the media 31 on which they are printed, as far as the print head 36 is concerned, they both lie on the print path 32 along the left-and-right (LR) direction of the arrow LR. The prior print swath 60 has an acceleration region 62, a print region 64, an excess travel region 66 and a deceleration region 68. The current print swath 70 has an acceleration region 72, a print region 74 and a deceleration region 78. It is clear from the relative arrangements of the acceleration and deceleration regions of the two print swaths that the prior print swath 60 is covered by the print head 36 in a left-to-right direction, whereas the current print swath 70 is covered in a right-to-left direction. Note that the deceleration region 68 immediately chains together with the acceleration region 72. The print head 36 thus reverses direction only once to get from end point 65 of the prior print region 64 to start point 73 of the current print region. An excess travel time between the prior print swath 60 and the current print swath 70 is thus computed by the look-ahead system 40 using the following method:

$$t=S/V \tag{1}$$

where t is the excess travel time of the current print swath 70, S is the distance traveled by the print head 36 along the print track 32 to get from the end point 65 to the start point 73, indicated by $S_1$ in FIG. 9, and V is the printing speed of the print head 36. Of course, many other arrangements of prior and current print swaths are possible, with various degrees and manners of overlapping or non-overlapping of the two print swaths. But the following general condition remains true: If the print head 36 reverses direction only once to get between prior and current print swaths, then the excess travel time for the current print swath is computed as the distance from the end point of the print region of the prior print swath to the start point of the print region of the current print swath (S) divided by the printing speed of the print head 36 (V), as given by equation (1). The distance is, of course, along the line LR of the print path 32, and includes no vertical components.

Figure 10:
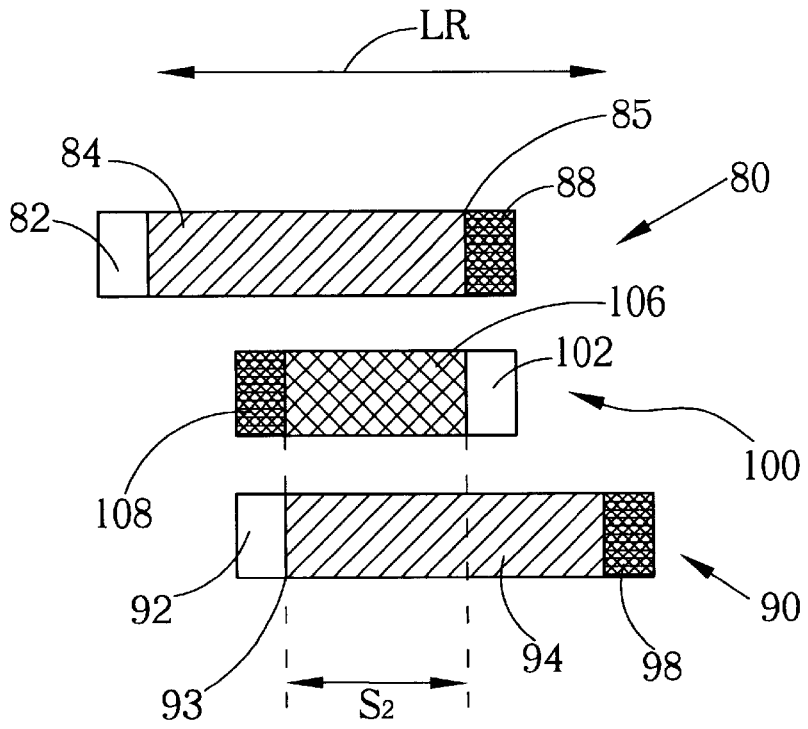
FIG. 10 illustrates an excess travel time satisfying a second condition of the present invention.

If the print head 36 reverses direction twice to get from the end point of a prior print swath to the start point of a current print swath, then the look-ahead system 40 uses the following method to compute the excess travel time between these two print swaths:

$$t=(S/V)+t_a+t_d \tag{2}$$

where t is the excess travel time for the current print swath, S is the distance from the end point of the print region of the prior print swath to the start point of the print region of the current print swath, V is the printing speed of the print head 36, $t_a$ is the time required for the print head 36 to move through an acceleration region, and $t_d$ is the time required for the print head 36 to move through a deceleration region. An example of this is shown in FIG. 10, which illustrates an excess travel time satisfying this second condition of the present invention. A prior print swath 80 has an acceleration region 82, a printing region 84 and a deceleration region 88. A current print swath 90 has an acceleration region 92, a printing region 94 and a deceleration region 98. Both the prior print swath 80 and the current print swath 90 are traversed by the print head 36 in the same left-to-right manner, as indicated by the arrangement of their acceleration 82, 92 and deceleration 88, 98 regions. However, between these print swaths is a region of excess travel 100. This region 100 is not a true print swath as it has no printing region. It represents, simply, the "back-tracking" of the print head 36 to get from end point 85 of the prior print swath 80 to start point 93 of the current print swath 90. The prior print swath 80 and current print swath 90 are thus chained together through the intermediate region of excess travel 100. The value of S for equation (2) is the distance along LR from endpoint 85 to start point 93, and is indicated by S2 in FIG. 10. The value $t_a$ of equation (2) is incurred by acceleration region 102 of region 100, and simply represents the amount of time required by the print head 36 to travel through the acceleration region 102. Similarly, the value $t_d$ of equation (2) is incurred by deceleration region 108 of the region 100, and represents the amount of time required by the print head 36 to travel through the deceleration region 108.

Figure 11:
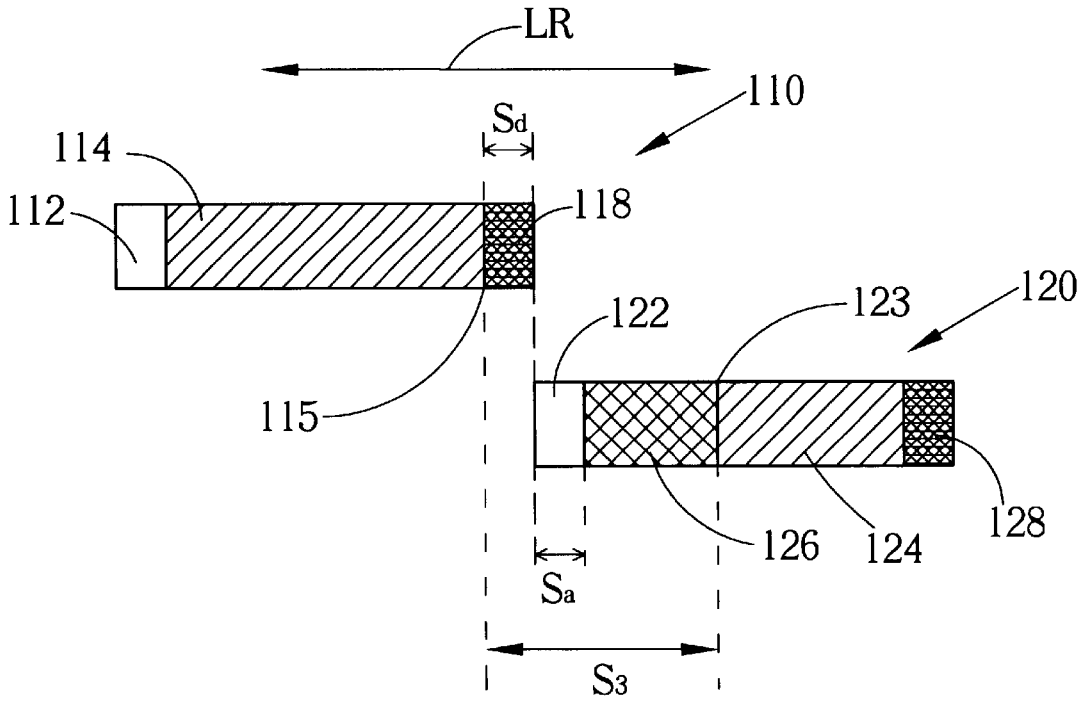
FIG. 11 illustrates an excess travel time satisfying a third condition of the present invention.

If the print head 36 does not reverse direction to get from the end point of a prior print swath to the start point of a current print swath, and the deceleration region of the prior print swath does not overlap the acceleration region of the current print swath, then the look-ahead system 40 uses the following method to compute the excess travel time:

$$t=[S-(S_a+S_d)]/V \tag{3}$$

where t is the excess travel time for the current print swath, S is the distance from the end point of the prior print swath to the start point of the current print swath, $S_a$ is the width along LR of an acceleration region, $S_d$ is the width along LR of a deceleration region, and V is the printing speed of the print head 36. This is shown in FIG. 11, which illustrates an excess travel time satisfying this third condition of the present invention. A prior print swath 110 has an acceleration region 112, a printing region 114 and a deceleration region 118. A current print swath 120 has an acceleration region 122, a print region 124, a region of excess travel 126 and a deceleration region 128. The prior print swath 110 is covered by the print head 36 in a left-to-right manner, and then the current print swath 120 is subsequently covered by the print head 36, also in a left-to-right manner. The print head 36 does not change direction to get from the prior print swath 110 to the current print swath 120. The media 31 is advanced while the print head 36 is between the prior print swath 110 and the current print swath 120. In FIG. 11, S of equation (3) is indicated by arrow $S_3$, which is the distance along LR from end point 115 of the prior print swath 110 to start point 123 of the current print swath 120. $S_a$ of equation (3) is indicated by arrow $S_a$ which is simply the width along LR of the deceleration region 118. Similarly, $S_d$ of equation (3) is indicated by arrow $S_d$, which is the width along LR of the acceleration region 122. Equation (3) is essentially the width of the excess travel region 126 divided by the printing speed of the print head 36. Note that the acceleration region 122 immediately follows the deceleration region 118.

Figure 12:
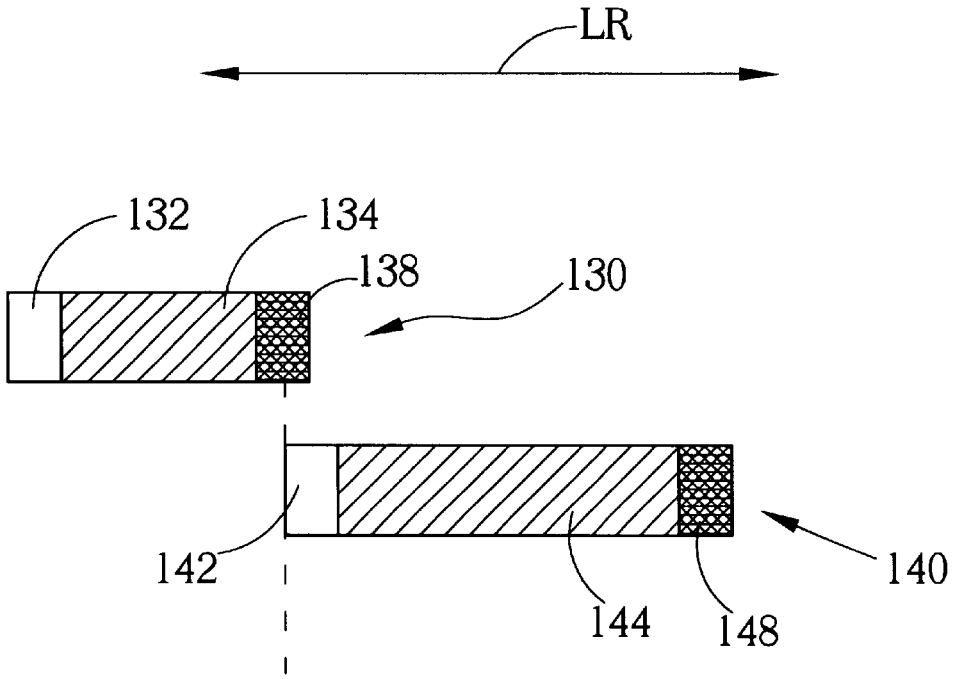
FIG. 12 illustrates an excess travel time satisfying a fourth condition of the present invention.

Finally, if the print head 36 does not reverse direction to get from the end point of a prior print swath to the start point of a current print swath, and the deceleration region of the prior print swath overlaps the acceleration region of the current print swath, then the look-ahead system 40 uses the following method to compute the excess travel time:

$$t=t_a+t_d \tag{4}$$

where t is the excess travel time for the current print swath, $t_a$ is the time required for the print head 36 to move through an acceleration region, and $t_d$ is the time required for the print head 36 to move through a deceleration region. This is shown in FIG. 12, which illustrates an excess travel time satisfying this fourth condition of the present invention. A prior print swath 130 has an acceleration region 132, a printing region 134 and a deceleration region 138. A current print swath 140 has an acceleration region 142, a print region 144 and a deceleration region 148. The prior print swath 130 is covered by the print head 36 in a left-to-right manner, and then the current print swath 140 is subsequently covered by the print head 36, also in a left-to-right manner. The print head 36 does not change direction to get from the prior print swath 130 to the current print swath 140. The media 31 is advanced while the print head 36 is between the prior print swath 130 and the current print swath 140. The deceleration region 138 of the prior print swath 130 overlaps the acceleration region 142 of the current print swath 140. The constant $t_a$ is the time required by the print head to move through a typical acceleration region, such as the acceleration region 132. Similarly, constant $t_d$ is the time required by the print head to move through a typical deceleration region, such as the deceleration region 148. It's worth noting that the time required by the print head 36 to move through the overlapping regions 138 and 142 is actually less than that given by equation (4). Equation (4) is simply an easy, worst-case prediction for the excess travel time incurred by the print head 36 to get to the start of the printing region 144. It should also be noted that the print head 36 may not come to a full stop in the deceleration region 138, but instead may simply slow down a bit to give the media 31 time to advance to the current print swath 140. The print head 36 can then use the remaining portions of the acceleration region 142 to come up to full printing speed.

Figure 13:
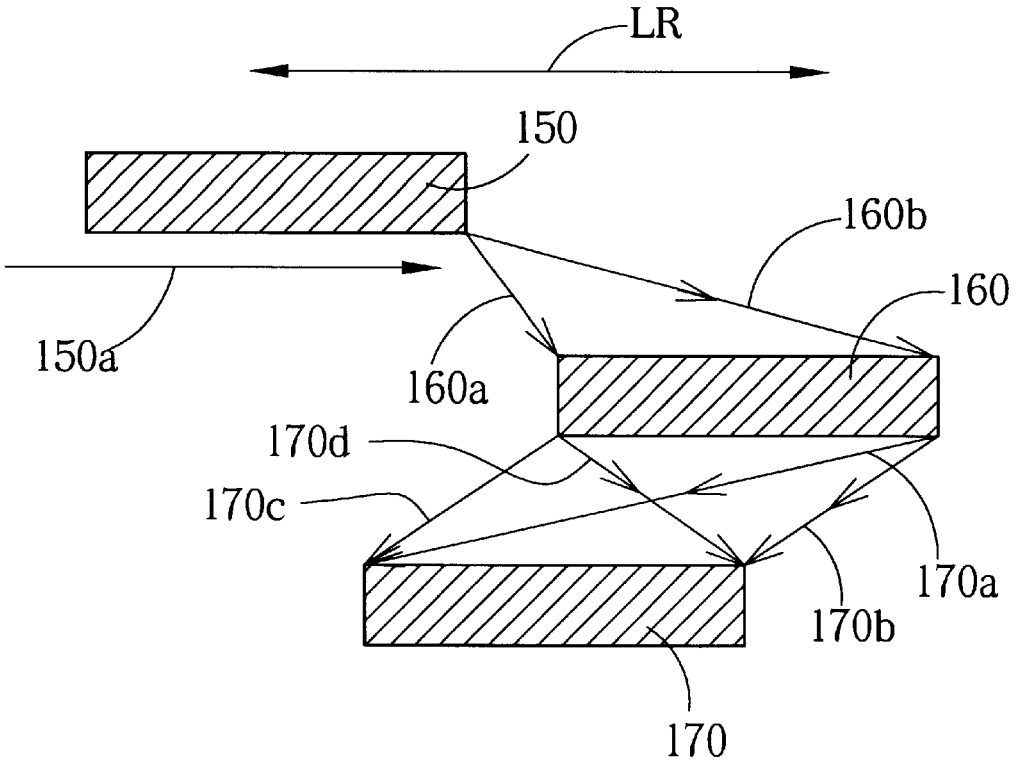
FIG. 13 illustrates three printing regions considered by a look-ahead system of the present invention.
Figure 14:
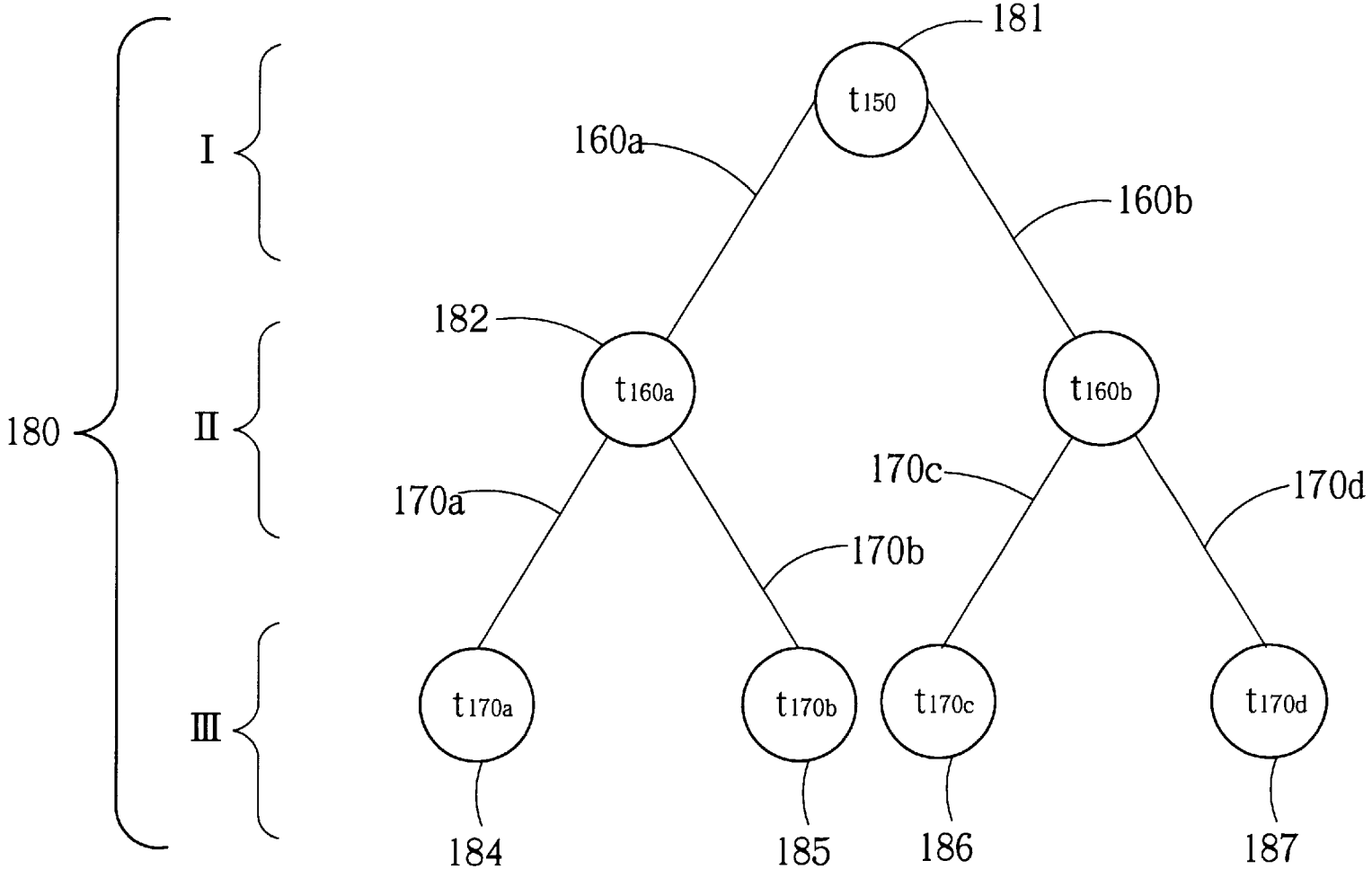
FIG. 14 shows a decision path tree for the printing regions of FIG. 13.

As noted above, the look-ahead system 40 finds a plurality of paths that cover at least the next three print swaths. For each of these paths, the look-ahead system 40 sums all of the excess travel times within the path to obtain a total excess travel time. The path having the shortest total excess travel time is then selected to be the path which the print head 36 will follow. The look-ahead system builds the plurality of different paths according to a binary tree structure. To better understand this, consider FIG. 13, with reference to FIGS. 6 and 7. FIG. 13 illustrates three printing regions 150, 160 and 170 considered by the look-ahead system 40. The print head 36 is positioned at an arbitrary point on the print path 32, having just finished a prior swath (not shown). A decision must be made: either to proceed to the left side of printing region 150, or proceed to the right side of printing region 150. For the sake of simplicity in the following, we shall assume that the print head 36 proceeds to the left side of printing region 150, and prints in a left-to-right fashion, ending up on the right side of printing region 150, as indicated by arrow 150*a*. Another decision must then be made: either to proceed to the left side of printing region 160 (indicated by arrow 160*a*), or proceed to the right side of printing region 160 (as indicated by arrow 160*b*). If the path of arrow 160*a* is chosen, then upon reaching the right side of printing region 160, another two choices present themselves: proceed to the left side of region 170, as indicated by arrow 170*a*, or to the right side of region 170, as indicated by arrow 170*b*. Similarly, if the path indicated by the arrow 160*b* is selected, then, upon reaching the left side of printing region 160, another two choices present themselves: the path as indicated by arrow 170*c* to the left side of region 170, or the path as indicated by arrow 170*d* to the right side of region 170. It should be clear to one in the art that the above can easily be represent by a binary decision tree, with subsequent descendant levels of the tree representing subsequent printing regions to be covered by the print head 36. Furthermore, it should be clear that such a binary tree could go to any arbitrary depth, limited only by the memory of the look-ahead system 40 and the algorithm used to implement the structure of such a decision tree. Please refer to FIG. 14, which shows a decision tree 180 for the printing regions 150, 160 and 170. The numerals for the arrow paths of FIG. 13 are repeated for the appropriate links between successive levels in the binary tree 180. Region I corresponds to printing region 150. Region II corresponds to printing region 160, and region III corresponds to printing region 170.

Although the printing regions 150, 160 and 170 of FIG. 13 are not true print swaths as they have no acceleration and deceleration regions, as soon as a particular path is chosen by the look-ahead system 40 for the print head 36 to follow, the acceleration and deceleration regions can be positioned to form proper print swaths. For example, if path 160*a* is chosen by the look-ahead system 140, then print region 160 will become a proper print swath, with an acceleration region to the left of the print region 160, and a deceleration region to the right of the printing region 160. Excess travel times for these print swaths can then be computed, using the methods described above. These excess print times are stored in the nodes of the binary tree 180. Thus, each node of the binary tree 180 stores the excess travel time incurred by the current print swath associated with the descendant level at which the node is located. For example, node 181 has an excess travel time of $t_{150}$. Node 182 stores an excess travel time $t_{160a}$, which is the excess travel time incurred by printing region 160 for the print head 36 to travel from the right side of the prior printing region 150 to the left side of the current printing region 160. Of course, if a print swath has no prior print swath, i.e., it is the first print swath considered, then its excess travel time would necessarily be zero.

The bottom nodes 184, 185, 186 and 187 of the binary tree 180, by their positions in the binary tree 180, represent different paths that cover all of the print swaths for the printing regions 150, 160 and 170. For example, the node 184 represents a left-to-right traversal of printing region 150, followed by a left-to-right traversal of printing region 160, and a left-to-right traversal of printing region 170. Conversely, the node 187 represents a left-to-right traversal of printing region 150, followed by successive right-to-left traversals of printing regions 160 and 170. Nodes 185 and 186 represent paths with alternating directions of travel of the print head 36 when traversing the printing regions 160 and 170. Finally, it should be noted that the total excess traveling time for a path is obtained by starting at the bottom node that corresponds to that path, and then working up the binary tree 180 to the root, summing together the excess travel times on the way up. For example, the total excess travel time for the path represent by the node 184 is given by $t_{170a}+t_{160a}+t_{150}$. The total excess travel time for the path represent by the node 185 is given by $t_{170b}+t_{160a}+t_{150}$. The total excess travel time for the path represent by the node 186 is given by $t_{170c}+t_{160b}+t_{150}$. And the total excess travel time for the path represent by the node 187 is given by $t_{170d}+t_{160b}+t_{150}$. The look-ahead system 40 selects the path that has the shortest total excess travel time. This path is then used by the control circuit 38 to direct the movements of the print head 36.

The above discussion has limited itself to an initial left-to-right traversal of the printing region 150. There are, consequently, only four bottom nodes in the binary tree 180. This is, in fact, only half of the structure of the binary tree 180. Another set of four nodes must exist, each with a corresponding excess travel time, for an initial right-to-left traversal of the printing region 150. These nodes, for the sake of simplicity, have been left out, as the number of nodes grows exponentially with the number of separate print swaths considered.

In contrast to the prior art, the present invention provides a look-ahead system that determines a plurality of different paths that will cover at least the next three print swaths. The look-ahead system computes the total excess travel time required by the print head to cover each path. The look-ahead system then selects the path having the shortest excess travel time. This path is then used by the control circuitry within the printer to guide the print head so as to reduce the time required for a printing process.

Those skilled in the art will readily observe that numerous modifications and alterations of the device may be made while retaining the teachings of the invention. Accordingly, the above disclosure should be construed as limited only by the metes and bounds of the appended claims.

What is claimed is:

1. A printing device comprising:

a print path disposed along a left-and-right direction;

a driving system adapted for moving a print head left or right along the print path, the print head performing a printing operation for forming at least a pixel;

a control circuit for controlling the driving system; and a look-ahead system for determining a plurality of different paths that cover at least three print swaths, computing a print time required by the driving system to cover the path, and selecting a path having an optimal print time.

2. The printing device of claim 1 wherein each print swath comprises an acceleration region, a print region, and a deceleration region, the print region between the acceleration region and the deceleration region, and the driving system uses the acceleration region to accelerate the print head up to a print speed and uses the deceleration region to bring the print head to rest; wherein the different paths each sequentially connect an acceleration region of a current print swath to the deceleration region of a prior print swath.

3. The printing device of claim 2 wherein each print region has a start point at which the printing operation for the print swath begins, and an end point at which the printing operation for the print swath ends, and an excess travel time is required to move the print head from the end point of the print region of the prior print swath to the start point of the print region of the current print swath, the look-ahead system computing the total of the excess travel times associated with each print swath for each path to obtain the print time for that path, the path selected with the optimal print time being the path with the shortest print time.

4. The printing device of claim 3 wherein if the print head reverses direction only once to get from the end point of the print region of the prior print swath to the start point of the print region of the current print swath then the look-ahead system computes the associated excess travel time for the current print swath as:

$$t=S/V$$

where t is the excess travel time for the current print swath, S is related to the distance along the print path from the end point of the print region of the prior print swath to the start point of the print region of the current print swath, and V is related to the print speed.

5. The printing device of claim 3 wherein if the print head reverses direction twice to get from the end point of the print region of the prior print swath to the start point of the print region of the current print swath then the look-ahead system computes the associated excess travel time for the current print swath as:

$$t=(S/V)+t_a+t_d$$

where t is the excess travel time for the current print swath, S is related to the distance along the print path from the end point of the print region of the prior print swath to the start point of the print region of the current print swath, V is related to the print speed, $t_a$ is related to the time required for the print head to move through an acceleration region, and $t_d$ is related to the time required for the print head to move through a deceleration region.

6. The printing device of claim 3 wherein if the print head does not reverse direction to get from the end point of the print region of the prior print swath to the start point of the print region of the current print swath, and the deceleration region of the prior print swath does not overlap the acceleration region of the current print swath, then the look-ahead system computes the associated excess travel time for the current print swath as:

$$t=[S-(S_a+S_d)]/V$$

where t is the excess travel time for the current print swath, S is related to the distance along the print path from the end point of the print region of the prior print swath to the start point of the print region of the current print swath, $S_a$ is related to the print head traveling distance through an acceleration region, $S_d$ is related to the print head traveling distance through a deceleration region, and V is related to the print speed.

7. The printing device of claim 3 wherein if the print head does not reverse direction to get from the end point of the print region of the prior print swath to the start point of the print region of the current print swath, and the deceleration region of the prior print swath overlaps the acceleration region of the current print swath, then the look-ahead system computes the associated excess travel time for the current print swath as:

$$t=t_a+t_d$$

where t is the excess travel time for the current print swath, $t_a$ is related to the time required for the print head to move through an acceleration region, and $t_d$ is related to the time required for the print head to move through a deceleration region.

8. The printing device of claim 3 wherein the number of different paths determined by the look-ahead system is an exponential function with the number of print swaths considered by the look-ahead system.

9. The printing device of claim 8 wherein the different paths determined by the look-ahead system effectively conform to a binary tree structure, each level of the binary tree representing one print swath, each branch of the binary tree representing either a leftward movement of the print head to get to the current print swath, or a rightward movement of the print head to get to the current print swath, each node of the binary tree holding an excess travel time; wherein the nodes at the bottom level of the binary tree each represent a different path that cover the print swaths.

10. The printing device of claim 9 wherein the print time for a path is obtained by traversing the binary tree from the root of the binary tree to the bottom node that corresponds to the path, and summing together all of the excess travel times held in the nodes passed while traversing the binary tree to obtain the print time of the path.

11. A method for successively positioning a print head of aprinting device, the method comprising:

obtaining at least three print swaths, the print swaths to be sequentially printed, and the print swaths arranged along a left-and-right direction;

determining a plurality of different paths that cover the print swaths;

for each of the different paths, computing a print time required to cover the path; and selecting a path having an optimal print times.

12. The method of claim 11 wherein each print swath comprises an acceleration region, a print region, and a deceleration region, the print region between the acceleration region and the deceleration region, the acceleration region being used to accelerate the print head up to a print speed, the deceleration region being used to bring the print head to rest; wherein the different paths each sequentially connect an acceleration region of a current print swath to the deceleration region of a prior print swath.

13. The method of claim 12 wherein each print region has a start point at which a printing operation for the print swath begins, and an end point at which the printing operation for the print swath ends, the print head forming at least a pixel during the printing operation, and an excess travel time is required to move the print head from the end point of the print region of the prior print swath to the start point of the print region of the current print swath; wherein the print time for each path is obtained by computing the total of the excess travel times associated with each print swath of the path, and a path selected with the optimal print times being the path with the shortest print time.

14. The method of claim 13 wherein if the print head reverses direction only once to get from the end point of the print region of the prior print swath to the start point of the print region of the current print swath then the associated excess travel time for the current print swath is computed as:

$$t=S/V$$

where t is the excess travel time for the current print swath, S is related to the distance along the print path from the end point of the print region of the prior print swath to the start point of the print region of the current print swath, and V is related to the print speed.

15. The method of claim 13 wherein if the print head reverses direction twice to get from the end point of the print region of the prior print swath to the start point of the print region of the current print swath then the associated excess travel time for the current print swath is computed as:

$$t=(S/V)+t_a+t_d$$

where t is the excess travel time for the current print swath, S is related to the distance along the print path from the end point of the print region of the prior print swath to the start point of the print region of the current print swath, V is related to the print speed, $t_a$ is related to the time required for the print head to move through an acceleration region, and t*d* is related to the time required for the print head to move through a deceleration region.

16. The method of claim 13 wherein if the print head does not reverse direction to get from the end point of the print region of the prior print swath to the start point of the print region of the current print swath, and the deceleration region of the prior print swath does not overlap the acceleration region of the current print swath, then the associated excess travel time for the current print swath is computed as:

$$t=[S-(S_a+S_d)]/V$$

where t is the excess travel time for the current print swath, S is related to the distance along the print path from the end point of the print region of the prior print swath to the start point of the print region of the current print swath, $S_a$ is related to the print head traveling distance through an acceleration region, $S_d$ is related to the print head traveling distance through a deceleration region, and V is related to the print speed.

17. The method of claim 13 wherein if the print head does not reverse direction to get from the end point of the print region of the prior print swath to the start point of the print region of the current print swath, and the deceleration region of the prior print swath overlaps the acceleration region of the current print swath, then the associated excess travel time for the current print swath is computed as:

$$t=t_a+t_d$$

where t is the excess travel time for the current print swath, $t_a$ is related to the time required for the print head to move through an acceleration region, and $t_d$ is related to the time required for the print head to move through a deceleration region.

18. The method of claim 13 wherein the number of different paths is an exponential function with the number of print swaths.

19. The method of claim 18 wherein the different paths effectively conform to a binary tree structure, each level of the binary tree representing one print swath, each branch of the binary tree representing either a leftward movement of the print head to get to the current print swath, or a rightward movement of the print head to get to the current print swath, each node of the binary tree holding an excess travel time; wherein the nodes at the bottom level of the binary tree each represent a different path that cover the print swaths.

20. The method of claim 19 wherein the print time for a path is obtained by traversing the binary tree from the root of the binary tree to the bottom node that corresponds to the path, and summing together all of the excess travel times held in the nodes passed while traversing the binary tree to obtain the print time of the path.

* * * * *